US011002278B2

(12) United States Patent
Cui et al.

(10) Patent No.: US 11,002,278 B2
(45) Date of Patent: May 11, 2021

(54) PUMP MECHANISM AND HORIZONTAL COMPRESSOR HAVING SAME

(71) Applicant: EMERSON CLIMATE TECHNOLOGIES (SUZHOU) CO., LTD., Jiangsu (CN)

(72) Inventors: Yonghua Cui, Jiangsu (CN); Xiaogeng Su, Jiangsu (CN)

(73) Assignee: Emerson Climate Technologies (Suzhou) Co., Ltd., Jiangsu (CN)

( * ) Notice: Subject to any disclaimer, the term of this patent is extended or adjusted under 35 U.S.C. 154(b) by 226 days.

(21) Appl. No.: 16/098,057

(22) PCT Filed: May 3, 2017

(86) PCT No.: PCT/CN2017/082832
§ 371 (c)(1),
(2) Date: Oct. 31, 2018

(87) PCT Pub. No.: WO2017/190651
PCT Pub. Date: Nov. 9, 2017

(65) Prior Publication Data

US 2019/0145414 A1 May 16, 2019

(30) Foreign Application Priority Data

May 3, 2016 (CN) ..... 201620386467.9

(51) Int. Cl.
*F04C 29/02* (2006.01)
*F04C 18/02* (2006.01)
(Continued)

(52) U.S. Cl.
CPC ..... *F04C 29/026* (2013.01); *F04C 18/0215* (2013.01); *F04C 23/008* (2013.01);
(Continued)

(58) Field of Classification Search
CPC .. F04C 29/026; F04C 18/0215; F04C 23/008; F04C 29/025; F04C 29/028; F04C 29/023; F01C 21/007
(Continued)

(56) References Cited

U.S. PATENT DOCUMENTS 5,358,392 A 10/1994 Ukai
5,445,507 A * 8/1995 Nakamura ..... F01C 21/102 418/55.1
(Continued)

FOREIGN PATENT DOCUMENTS

CN 1080981 A 1/1994
CN 1172216 A 2/1998
(Continued)

OTHER PUBLICATIONS

English translation of CN 2017455329 by Espacenet Dec. 10, 2020.*
(Continued)

*Primary Examiner* — Deming Wan
(74) *Attorney, Agent, or Firm* — Hamess, Dickey & Pierce, P.L.C.

(57) ABSTRACT

A pump mechanism for a horizontal compressor comprises: a partition plate disposed in a housing of the horizontal compressor to separate an oil compartment from a motor compartment provided with a motor; and a pump assembly including a first pump and a second pump located in the oil compartment. The first pump sucks oil from the motor compartment to the oil compartment. The second pump delivers the oil from the oil compartment to a lubrication channel inside a rotary shaft. The partition plate is made from a flat plate, and includes: a plate main body extending in a vertical direction; and a flange portion extending from the peripheral edge of the plate main body in an axial
(Continued)

direction and secured to the housing. A horizontal compressor including the pump mechanism is also provided.

14 Claims, 6 Drawing Sheets

(51) Int. Cl.
*F04C 23/00* (2006.01)
*F01C 21/00* (2006.01)

(52) U.S. Cl.
CPC ..... *F04C 29/02* (2013.01); *F04C 29/025* (2013.01); *F04C 2240/809* (2013.01)

(58) Field of Classification Search
USPC ..... 418/94
See application file for complete search history.

(56) References Cited

U.S. PATENT DOCUMENTS

| | | | | |
|---|---|---|---|---|
| 5,580,233 | A * | 12/1996 | Wakana | F01C 21/02 418/94 |
| 6,050,794 | A | 4/2000 | Noboru et al. | |
| 6,322,339 | B1 | 11/2001 | Mitsunaga et al. | |
| 6,589,035 | B1 * | 7/2003 | Tsubono | F04C 18/0215 418/55.5 |
| 8,888,476 | B2 * | 11/2014 | Hasegawa | F04C 23/008 418/55.6 |
| 2008/0008614 | A1 | 1/2008 | Mizuno et al. | |
| 2009/0038150 | A1 * | 2/2009 | Kishikawa | B23K 33/006 29/888.02 |
| 2011/0085925 | A1 | 4/2011 | Fan et al. | |

FOREIGN PATENT DOCUMENTS

| | | | | |
|---|---|---|---|---|
| CN | 1474059 | A | 2/2004 | |
| CN | 101100997 | A | 1/2008 | |
| CN | 205578273 | U | 9/2016 | |
| CN | 2017-456329 | * | 6/2017 | F04C 29/02 |
| JP | 2924557 | B2 | 7/1999 | |

OTHER PUBLICATIONS

International Search Report for PCT/CN2017/082832, ISA/CN, Haidian District, Beijing, dated Aug. 7, 2017, with English translation.

Extended European Search Report regarding Application No. 17792477.6 dated Aug. 28, 2019.

* cited by examiner

PUMP MECHANISM AND HORIZONTAL COMPRESSOR HAVING SAME

CROSS REFERENCE TO RELATED APPLICATIONS

This disclosure is the national phase of International Application No. PCT/CN2017/082832 titled "PUMP MECHANISM AND HORIZONTAL COMPRESSOR HAVING SAME" and filed on May 3, 2017, which claims the priority to Chinese Patent Application No. CN201620386467.9, filed with the Chinese Patent Office on May 3, 2016, the entire disclosure of which is incorporated herein by reference.

FIELD OF THE INVENTION

The present disclosure relates to a pumping mechanism for a horizontal compressor and a horizontal compressor having the pumping mechanism.

BACKGROUND OF THE INVENTION

A compressor generally includes a housing, a compression mechanism accommodated in the housing, a motor that drives the compression mechanism, a rotary shaft that is driven by the motor, and the like. For a vertical compressor, an oil sump is generally provided at the bottom of the compressor housing, and an oil pump is provided at a bottom end of the rotary shaft to pump the oil accumulated in the oil sump to an oil hole axially running in the rotary shaft so as to supply lubricating oil to various movable components of the compressor. However, in some applications, horizontal compressors are required to be used due to space constraints. Since an oil sump cannot be naturally formed at the end of the rotary shaft for a horizontal compressor, various pumping mechanisms for horizontal compressors have been designed in the conventional technology to realize the pumping and delivery of the lubricating oil, for example, a pumping mechanism for introducing oil in a high pressure zone into the oil pump at the end of the rotary shaft, or a pumping mechanism in which an oil sump is formed by a double-layered housing. However, these technologies have disadvantages such as low energy efficiency and high complexity. In addition, there is a pumping mechanism in which a separate oil sump is defined by a vertical partition member, and a pump is used to supply oil to the rotary shaft. However, in this structure, the partition member is generally complicated, and has a high manufacturing cost and is difficult to be fixed to the housing hermetically, and the horizontal compressor having this pumping mechanism is not lubricated as good as a vertical compressor.

SUMMARY OF THE INVENTION

An object of the present disclosure is to provide a simple pumping mechanism capable of improving a lubrication effect.

According to an aspect of the present disclosure, a pumping mechanism for a horizontal compressor is provided, which includes a partition plate and a pump assembly. The partition plate is configured to separate, in a housing of the horizontal compressor, an oil compartment from a motor compartment in which a motor is provided. The pump assembly includes a first pump and a second pump which are located in the oil compartment. The first pump pumps oil from the motor compartment to the oil compartment, and the second pump supplies oil from the oil compartment to a lubrication channel in a rotary shaft of the horizontal compressor. The partition plate is made of a flat plate, and the partition plate has: a partition plate main body extending in a vertical direction; and a flange portion extending axially from a peripheral edge of the partition plate main body and fixed to the housing of the horizontal compressor.

Optionally, the partition plate main body and the flange portion are integrally formed by stamping a metal plate.

Optionally, the partition plate main body is provided with a central opening, and the central opening surrounds and is fixed to a bearing housing configured to support the rotary shaft.

Optionally, the flange portion is welded to the housing at multiple through holes circumferentially arranged in the housing of the horizontal compressor.

Optionally, an annular sealing member is provided between the flange portion and the housing of the horizontal compressor, to separate in a sealed manner the oil compartment from the motor compartment over the entire circumference of the flange portion.

Optionally, a circumferential recess configured to accommodate the annular sealing member is provided in an outer circumferential surface of the flange portion or an inner circumferential surface of the housing.

Optionally, a radial gap open to the circumferential recess is provided in the outer circumferential surface of the flange portion or the inner circumferential surface of the housing, and the radial gap has a radial dimension less than a radial dimension of the circumferential recess, such as to allow the annular sealing member to unidirectionally enter the circumferential recess only by way of the radial gap.

Optionally, multiple air gap inspection holes are provided in the partition plate main body, and the air gap inspection holes are plugged in a sealed manner in the process of installation.

Optionally, an overflow hole is provided in the partition plate main body at a predetermined height thereof, and is configured to communicate the oil compartment with the motor compartment.

Optionally, the overflow hole is arranged in the partition plate main body at a position obliquely above the bearing housing supporting the rotary shaft, such that projections of the overflow hole and the bearing housing on a horizontal plane are not overlapped.

Optionally, the horizontal compressor is a low side scroll compressor.

Optionally, the partition plate main body is further provided therein with an oil inlet hole, and an oil suction pipe of the pump assembly runs through the oil inlet hole into the motor compartment.

Optionally, the first pump and the second pump are each a rotor pump driven by the rotary shaft, and the first pump has a displacement greater than a displacement of the second pump.

Optionally, the pumping mechanism further includes a first spacer, a second spacer and an end cover. The first spacer is located between the bearing housing supporting the rotary shaft and the first pump. The first spacer is provided therein with an orifice to introduce oil pumped by the first pump into an inner cavity of the bearing housing, and the oil enters the oil compartment via a radial opening in the bearing housing. The second spacer is configured to separate the first pump from the second pump. The end cover is located on a side, opposite to the second spacer, of the second pump. The end cover is provided therein with an orifice to introduce oil pumped by the second pump into a central recess of the end cover, and the central recess is in communication with the lubrication channel.

A horizontal compressor is further provided according to the present disclosure, which includes the pumping mechanism as described above.

Advantages of the pumping mechanism and the horizontal compressor according to the present disclosure lie in that they have simple structures, are convenient to install, and can improve lubrication effect.

BRIEF DESCRIPTION OF THE DRAWINGS

The features and advantages of the present disclosure will become more readily understood from the following description with reference to the accompanying drawings in which.

DETAILED DESCRIPTION

The following description of the preferred embodiments is merely exemplary and is by no means intended to limit the present disclosure, its application or usage. In the following description, "the horizontal direction" and "the vertical direction" refer to a direction in parallel with a horizontal plane in a natural state and a direction perpendicular to a horizontal plane, respectively.

Figure 1:
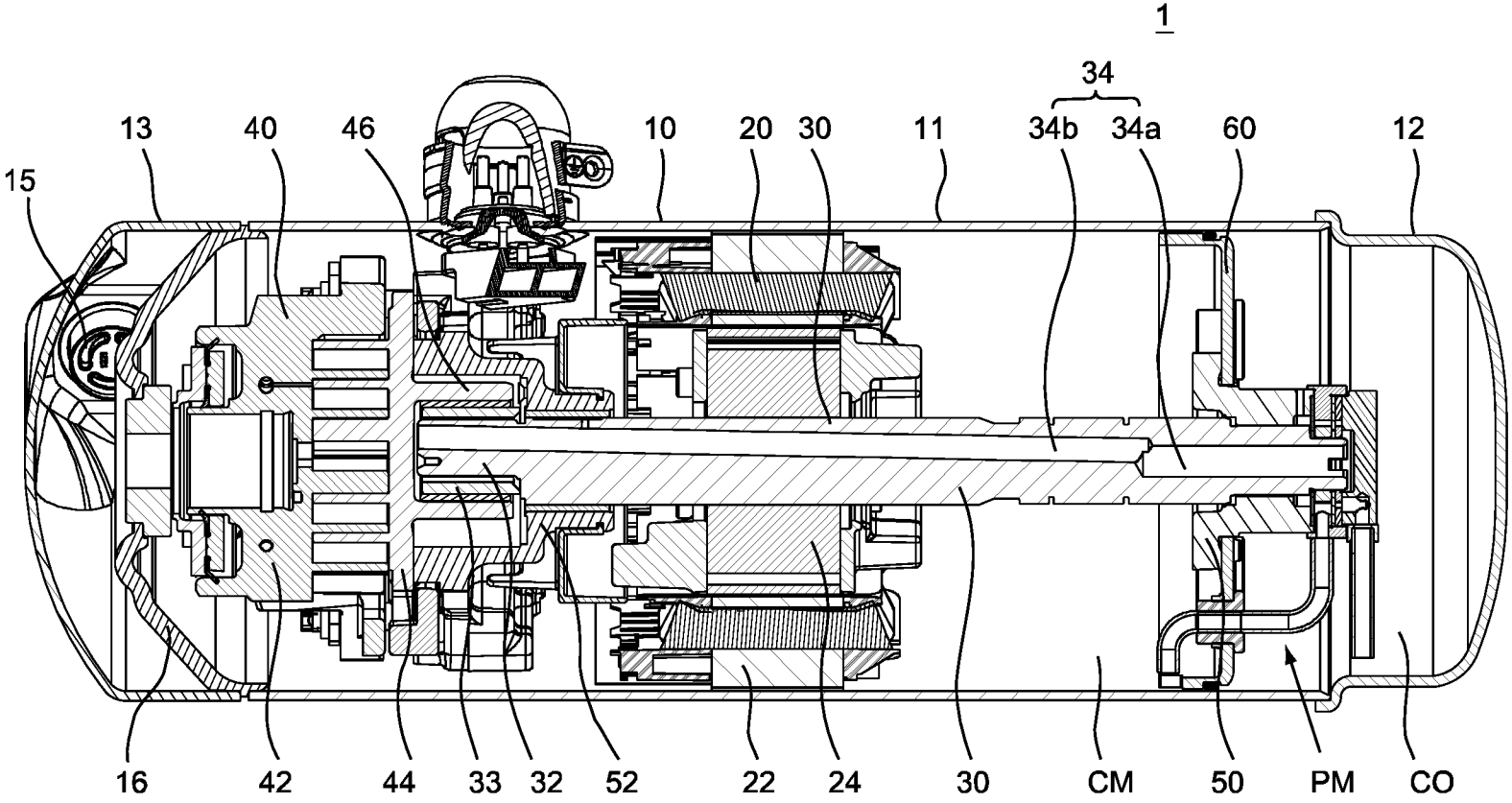
FIG. 1 is an overall view of a horizontal compressor to which the present disclosure is applied.

FIG. 1 is an overall view of a horizontal compressor 1. The horizontal compressor 1 includes a housing 10 having a substantially closed cylindrical shape, and the housing 10 includes a main body 11 at a middle portion and a first end cover 12 and a second end cover 13 fixed to both axial ends of the main body. A suction joint 14 (see FIG. 5) configured to suck refrigerant is mounted to the main body 11, and a discharge joint 15 (see FIG. 5) configured to discharge compressed refrigerant is mounted to the second end cover 13. A partition plate 16 extending substantially transversely is further arranged between the main body 11 and the second end cover 13 to partition an internal space of the compressor housing 10 into a high pressure side and a low pressure side. Specifically, a space between the second end cover 13 and the partition plate 16 constitutes a high pressure side space, and a space between the partition plate 16 and the first end cover 12 constitutes a low pressure side space. A motor 20, a rotary shaft 30 and a compression mechanism 40 are accommodated in the low pressure side space. The motor drives the compression mechanism 40 by means of the rotary shaft 30. This type of compressor is also referred to as a low side compressor.

In the example shown in FIG. 1, the motor 20 includes a stator 22 fixed to the housing 10 and a rotor 24 fixed to the rotary shaft 30. The rotary shaft 30 has a first end supported by a first bearing housing 50 (corresponding to a "bearing housing" in the claims) via a bearing and a second end supported by a second bearing housing 52 via a bearing. As a horizontal compressor, an extending direction of the rotary shaft 30 (or an axial direction of the horizontal compressor 1) is substantially parallel to the horizontal direction. The compression mechanism 40 includes a fixed scroll member 42 and an orbiting scroll member 44 that mesh with each other, and a series of compression chambers are formed between the fixed scroll member 42 and the orbiting scroll member 44. An eccentric crank pin 32 of the rotary shaft 30 is inserted into a hub portion 46 of the orbiting scroll member 44 via a bushing 33 to rotationally drive the orbiting scroll member 44 such that the orbiting scroll member 44 orbits the fixed scroll member 42 to compress the refrigerant sucked into the compression mechanism 40.

Similar to that in the conventional technology, a lubrication channel 34 is provided in the rotary shaft 30, and the lubrication channel 34 includes a concentric hole 34*a* at the first end and an eccentric hole 34*b* in communication with the concentric hole 34*a*. The eccentric hole 34*b* is radially offset from the concentric hole 34*a* and is deviated from the rotation axis of the rotary shaft 30, and the eccentric hole 34*b* is opened in the eccentric crank pin 32 of the rotary shaft 30. The oil is pumped into the concentric hole 34*a* by the pumping mechanism PM, and under the centrifugal force generated from rotation of the rotary shaft 30, the oil travels along the eccentric hole 34*b* towards the second end, and leaves the rotary shaft 30 to enter the eccentric crank pin 32, and then lubricates various moving components.

Figure 2:
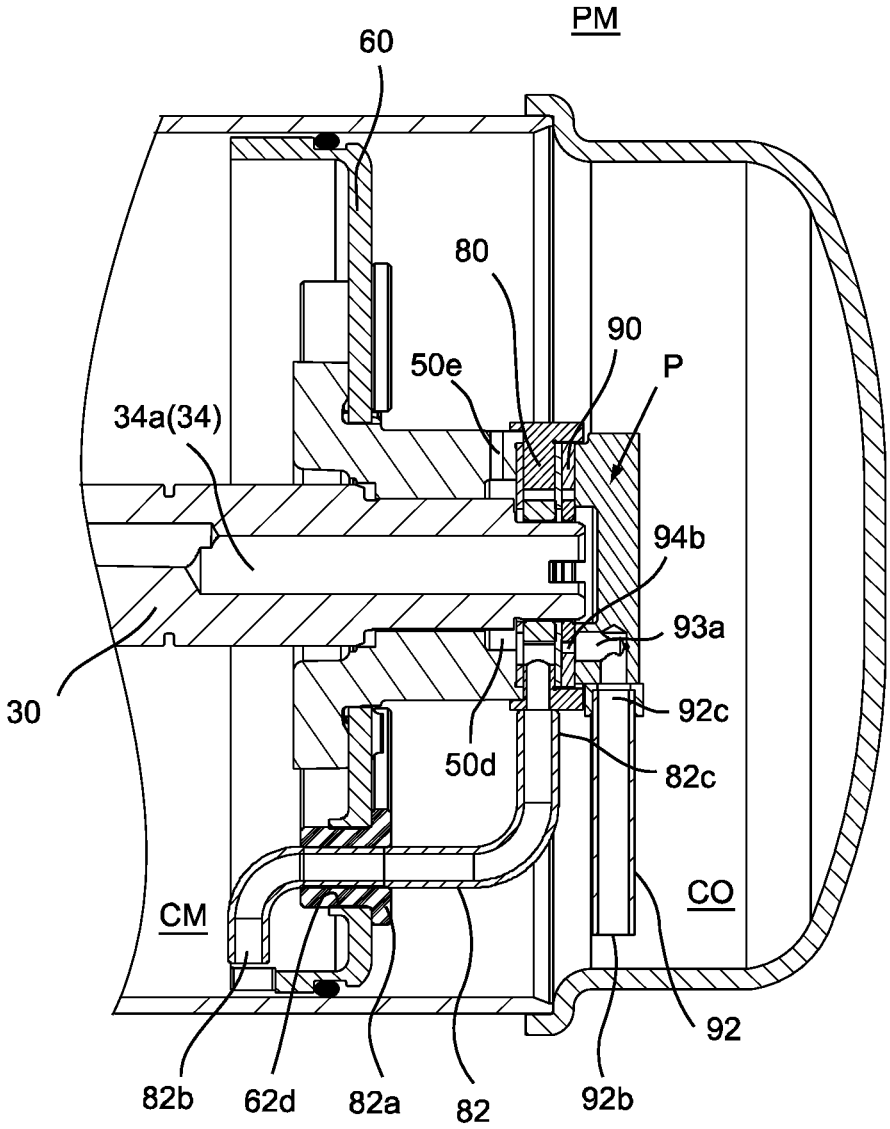
FIG. 2 is a sectional view of a pumping mechanism according to the present disclosure.

Referring to FIG. 2, the pumping mechanism PM will be described in detail below. The pumping mechanism PM mainly includes a partition plate 60 and a pump assembly P. The partition plate 60 is located near an axial end (a first end) of the compressor, to thereby separate, in the low pressure side space, an oil compartment CO from a motor compartment CM accommodating the motor 20. The oil compartment CO is located at a first side of the partition plate 60 (on a right side of the partition plate in FIG. 2), and the motor compartment CM is located at a second side of the partition plate 60 (on a left side of the partition plate in FIG. 2). In the following, the "first end" and "first side" generally refer to the right end/right side in FIG. 2 and the "second end" and "second side" generally refer to the left end/left side in FIG. 2 unless otherwise stated.

Figure 3:
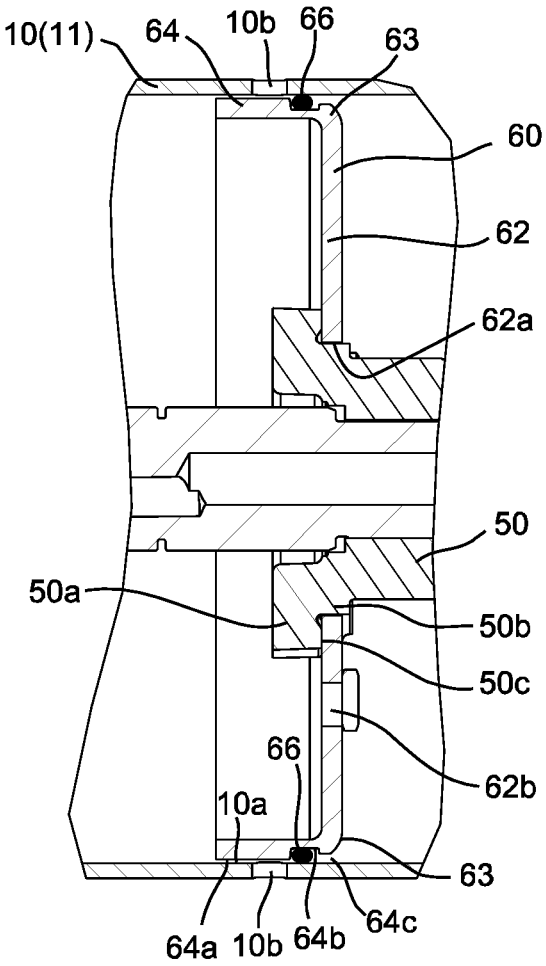
FIG. 3 is a sectional view of a partition plate portion according to the present disclosure.

Referring to FIG. 3, the partition plate 60 is made of a flat plate having a substantially uniform thickness, for example, made by stamping a metal plate, thereby forming a partition plate main body 62 and a flange portion 64 as described below. However, it can be understood that, in the case of meeting the strength requirements, the partition plate 60 may also be manufactured with a non-metal plate. Therefore, the use of a casting member having a complicated structure, a large weight, and a high material consumption is avoided. Thereby, the manufacturing process can be simplified, the material usage can be saved, and the manufacturing cost can be reduced.

The partition plate main body 62 extends in the vertical direction (or in a radial direction of the compressor), and the partition plate main body 62 has substantially an annular plate shape, that is, is continuous in a circumferential direction. A central opening 62*a* is provided in a central portion of the partition plate main body 62 for connection with the first bearing housing 50 of the horizontal compressor 1. Specifically, the first bearing housing 50 includes a first diameter portion 50*a* and a second diameter portion 50*b* which are adjacent to each other in the axial direction, and the first diameter portion 50*a* has an outer diameter greater than an outer diameter of the second diameter portion 50*b*, thereby forming a stepped surface 50*c*. The central opening 62*a* has a size slightly greater than the size of the second diameter portion 50*b* and less than the size of the first diameter portion 50*a*, so that the central opening 62*a* can be circumferentially fitted on the second diameter portion 50*b* and abut against the stepped surface 50*c*. The partition plate main body 62 is fixed to the first bearing housing 50 in a sealed manner by passing multiple fasteners F (see FIG. 7) through openings at corresponding positions of the partition plate main body 62 and the first diameter portion 50*a*. It can be understood that the first diameter portion 50*a* and the second diameter portion 50*b* are described here only for the purpose of describing the mounting of the partition plate main body 62, and the first bearing housing 50 may also have other diameter portions different from the first diameter portion 50*a* and the second diameter portion 50*b* as long as the central opening 62*a* can be fitted on the second diameter portion 50*b*. This type of connection is merely an example, and the partition plate main body 62 may be connected to the bearing housing 50 in a sealed manner by other ways.

Figure 4:
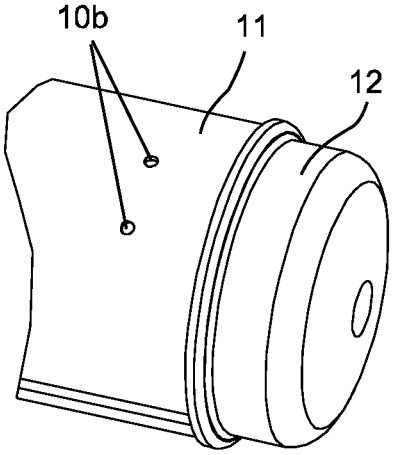
FIG. 4 is an external perspective view of one end of the horizontal compressor.

Referring to FIG. 3, the flange portion 64 extends axially from a peripheral edge of the partition plate main body 62 toward the motor compartment CM side and is fixed to the compressor housing 10, which is shown as being fixed to the main body 11 in this figure. Specifically, the flange portion 64 has a substantially cylindrical shape, and its outer surface 64*a* faces an inner surface 10*a* of the compressor housing 10. Multiple through holes 10*b* are provided in the compressor housing 10 at intervals in the circumferential direction, and the flange portion 64 is soldered to the compressor housing 10 by placing solder (not shown) into the through holes 10*b*. Each of the through holes 10*b* corresponds to a solder joint on the flange portion 64. The axial width of the flange portion 64 can be wide, so that the through holes 10*b* (see FIG. 4) in the conventional compressor housing 10 can be used for soldering. Therefore, the conventional compressor housing can be used, and the welding process same as that in the conventional technology can be adopted for welding, thus avoiding cost increases due to modifications to the part structure and process. In addition, spot welding is performed only at the multiple through holes 10*b*, which means that the entire circumference welding is not required to achieve the seal between the partition plate and the compressor housing, therefore, the welding step is simplified. In the example of this embodiment, the flange portion 64 extends in the axial direction toward the motor compartment CM side and is fixed to the main body 11 of the compressor housing 10. However, it should be understood that the flange portion 64 may also extend from the partition plate main body 62 towards the oil compartment CO side and be fixed to the first end cover 12 of the compressor housing, which will not be described in detail herein.

An annular sealing member 66, such as an O-ring, is arranged between the flange portion 64 and the compressor housing 10 to separate the oil compartment CO from the motor compartment CM in a sealed manner. The arrangement of the annular sealing member 66 will be described hereinafter. Referring to FIG. 3, in the axial direction and between the welding spots (through hole 10*b*) and a connection portion 63 between the partition plate main body 62 and the flange portion 64, a circumferential recess 64*b* is provided on the outer surface 64*a* of the flange portion 64. The circumferential recess 64*b* can accommodate the annular sealing member 66 and allows the annular sealing member 66 to be deformed when being pressed. A radial gap 64*c* is provided between the connection portion 63 and the circumferential recess 64*b*, and the radial gap 64*c* may be formed by machining (e.g., turning) the outer surface 64*a* of the flange portion 64, such that the annular sealing member 66 can axially pass through the radial gap 64*c* from the side of the connection portion 63 to enter into the circumferential recess 64*b*. The radial gap 64*c* has a radial dimension less than the radial dimension of the circumferential recess 64*b*, i.e., the circumferential recess 64*b* and the radial gap 64*c* form together a substantially L-shape. When the annular sealing member 66 is installed, the compressed annular sealing member 66 passes through the radial gap 64*c* to enter into the larger circumferential recess 64*b* and can be restored to some extent (for sealing purposes, the annular sealing member 66 in the circumferential recess 64*b* is still compressed without fully recovering the shape). Therefore, the radial gap 64*c* only allows the annular sealing member 66 to unidirectionally enter from the connection portion 63 into the circumferential recess 64*b*, while preventing the annular sealing member 66 from removing from the circumferential recess 64*b* along the radial gap. In this way, the annular sealing member 66 can be conveniently assembled and accommodated, and the seal between the partition plate 60 and the compressor housing 10 can be achieved by the annular sealing member 66.

It can be understood that, although the circumferential recess 64*b* and the radial gap 64*c* are both arranged in the outer circumferential surface of the flange portion 64 in the above described embodiment, one or both of the circumferential recess and the radial gap may also be alternatively provided in an inner circumferential surface of the housing 10 (for example, formed by machining the inner wall of the housing 10) as long as the annular sealing member 66 can pass through the radial gap into the circumferential recess.

Figure 5:
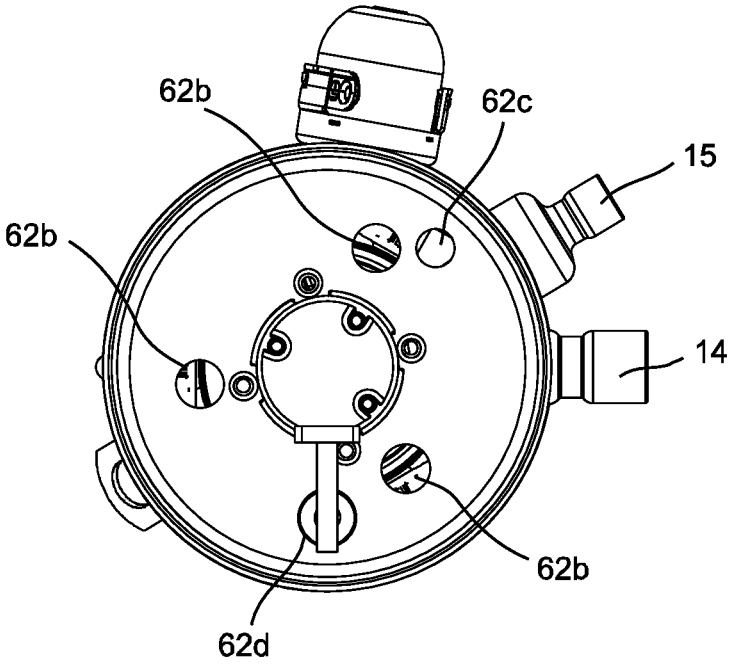
FIG. 5 is an end view of the compressor with an end cover removed.
Figure 6:
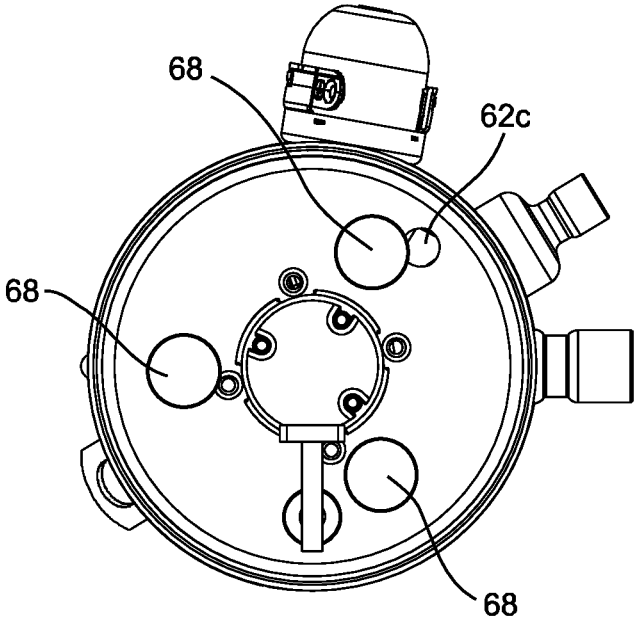
FIG. 6 is a view similar to FIG. 5, in which air gap inspection holes are plugged.

Referring to FIG. 5, optionally, in the partition plate main body 62, multiple (three in the figure) air gap inspection holes 62*b* are arranged in the circumferential direction for inspecting the air gap between the stator 22 and the rotor 24 of the motor 20 during assembly. The assembly process of the compressor includes steps of inserting the rotary shaft 30, to which the rotor 24, the first bearing housing 50 and the partition plate 60 are fixed, into the housing 10 to which the stator 22 is fixed. In the conventional technology, since the partition plate 60 blocks the view of the assembler, it is impossible to determine whether or not there is a proper air gap between the stator 22 and the rotor 24, and therefore, the assembling quality cannot be ensured. For this reason, in the present application, the multiple air gap inspection holes are provided in the partition plate main body 62 at positions substantially corresponding to the inner circumference of the stator 22 or the outer circumference of the rotor 24 in the radial direction to inspect the assembling air gap of the motor 20, and thus the correct assembling is ensured. Of course, the air gap inspection holes may also be provided at positions deviated from the inner circumference of the stator 22 or the outer circumference of the rotor 24 as long as the relative positions of the two can be observed through the air gap inspection holes. After the assembling is completed, each of the inspection holes 62*b* is hermetically blocked by a plugging member 68, and FIG. 6 shows the state after the plugging members 68 are installed. It can be understood that the plugging members 68 can be detachably or permanently fixed to the inspection holes 62*b*.

Referring to FIGS. 5 and 6, an overflow hole 62*c* is provided in the partition plate main body 62 at a predetermined height thereof, and the oil compartment CO is in communication with the motor compartment CM via the overflow hole 62*c*. The overflow hole 62*c* is capable of releasing the pressure in the oil compartment CO and maintaining the consistency (or balance) of the pressures in the oil compartment CO and the motor compartment CM, and when the oil level in the oil compartment CO is higher than the predetermined height, the lubricating oil can flow back into the motor compartment CM via the overflow hole 62*c*. The overflow hole 62*c* is arranged in the partition plate main body 62 at a position obliquely above the bearing housing 50, near a peripheral edge of the partition plate main body 62. In other words, the position of the overflow hole 62*c* is designed such that its projection on a horizontal plane is offset from (has no overlap with) the projection of the bearing housing 50 on a horizontal plane. Thus, when the lubricating oil flows down from the overflow hole 62*c*, the flow path of the lubricating oil may avoid the bearing and the rotary shaft which are rotating, thereby avoiding the case where the lubricating oil is thrown out all around by the rotating bearing and the rotating rotary shaft and is atomized, and is further carried away by the suctioned refrigerant to increase the amount of oil circulation of the system in an undesired manner.

The pump assembly P is described below with reference to FIGS. 2, 7 and 8. The pump assembly P includes a first pump 80 and a second pump 90 located in the oil compartment CO. The first pump 80 pumps lubricating oil from the motor compartment CM to the oil compartment CO, and the second pump 90 supplies oil from the oil compartment CO into the rotary shaft 30 of the compressor. In this embodiment, the first pump 80 and the second pump 90 are both rotor pumps and are each driven by the rotary shaft 30.

Figure 7:
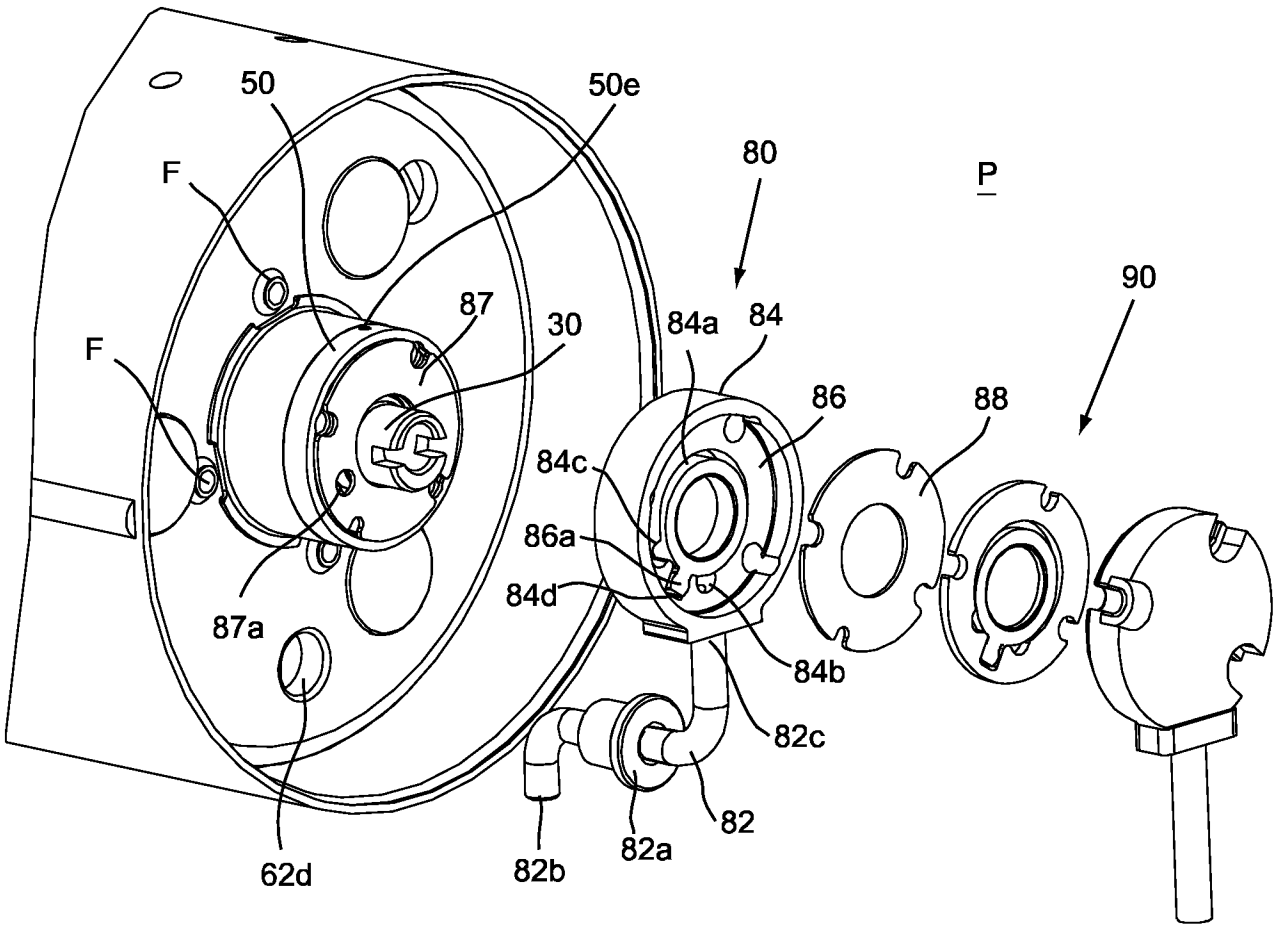
FIGS. 7 and 8 are exploded perspective views of the pumping mechanism according to the present disclosure viewed from different angles.

Referring to FIGS. 2 and 7, the first pump 80 includes a first oil suction pipe 82 that passes through an oil inlet hole 62*d* in the partition plate main body 62 in a sealed manner, for example, a sealing liner 82*a* seals between the first oil suction pipe 82 and the oil inlet hole 62*d*. One end 82*b* of the first oil suction pipe 82 opens to a lower portion of the motor compartment CM and opens downwards to facilitate oil intake. Referring to FIG. 7, the first pump 80 further includes a first pump casing 84 and a first rotor 86. The first pump casing 84 is fixed to the stationary bearing housing 50, and includes a central cavity 84*a*, an inlet 84*b* and an outlet 84*c* which are in communication with the central cavity, and a confinement recess 84*d*. The other end 82*c* of the first oil suction pipe 82 leads to the inlet 84*b* in the first pump casing 84 (the first oil suction pipe 82 corresponds to the "oil suction pipe" in the claims). The first rotor 86 has a substantially annular shape and is fixedly fitted on the end of the rotary shaft 30 and is accommodated within the central cavity 84*a* of the first pump casing 84. The first rotor 86 is provided with a lug 86*a* that is movably embedded within the confinement recess 84*d* in the first pump casing 84. A first spacer 87 and a second spacer 88 are respectively arranged on both sides of the first pump casing 84 to form a compression chamber between the first rotor 86 and the first pump casing 84. Thus, in a known manner in which a rotor pump operates, as the rotary shaft 30 rotates, the first rotor 86 swings inside the first pump casing 84 with the lug 86*a* as a fulcrum, to pressurize the oil entered from the inlet 84*b* of the pump casing 84, and discharge the oil from the outlet 84*c* of the pump casing 84. The oil discharged from the outlet 84*c* enters an inner cavity 50*d* of the bearing housing 50 through an orifice 87*a*, corresponding to the position of the outlet 84*c*, in the first spacer 87, and flows into the oil compartment CO via a radial opening 50*e*, in communication with the inner cavity 50, of the bearing housing 50. Thereby, the first pump 80 pumps oil from the motor compartment CM into the oil compartment CO.

Figure 8:
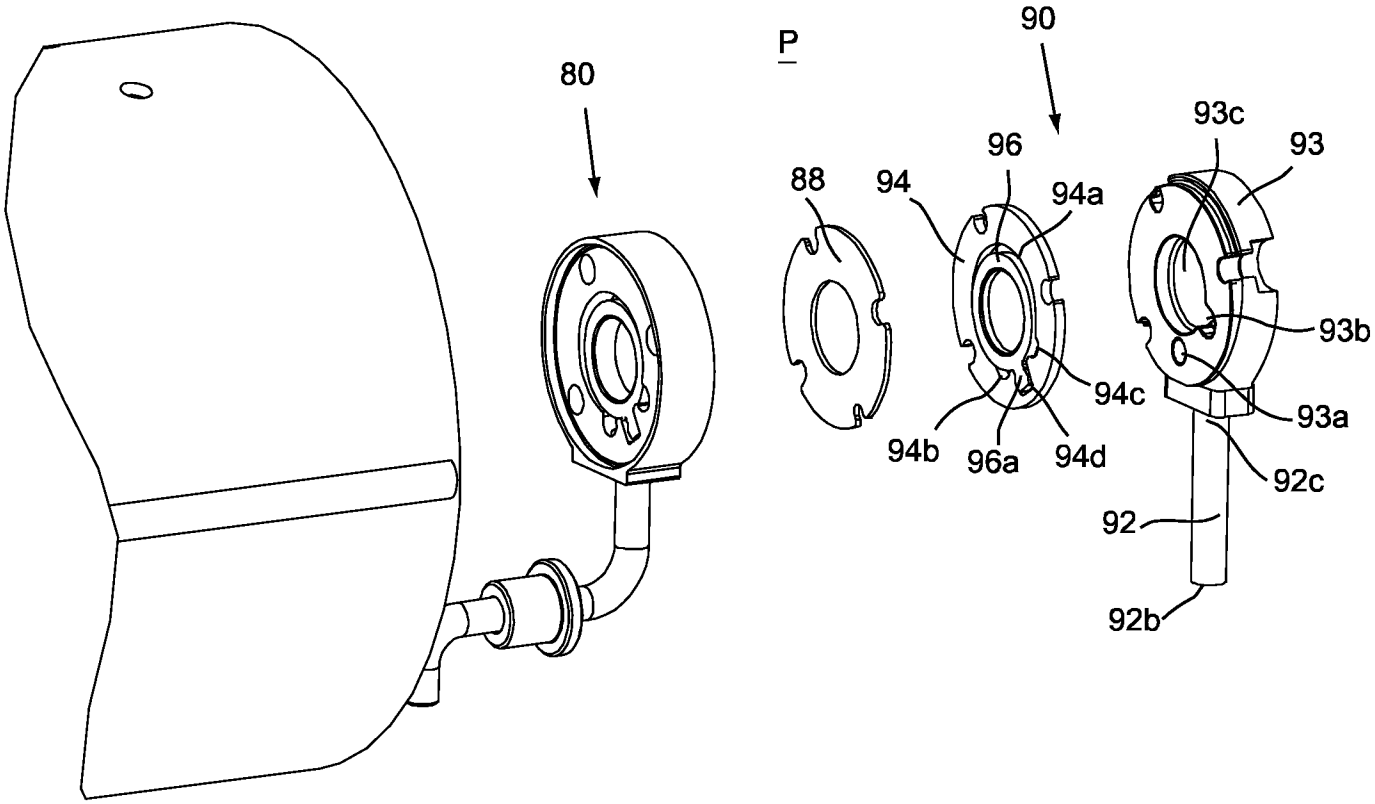

Referring to FIGS. 2 and 8, the second pump 90 is a pump similar to the first pump 80 and operates to pump oil from the oil compartment CO into the concentric hole 34*a* in the rotary shaft 30. The second pump includes a second oil suction pipe 92, and one end 92*b* of the second oil suction pipe 92 opens to a lower portion of the oil compartment CO and opens downwards to facilitate oil intake. The second pump 90 further includes an end cover 93, a second pump casing 94 and a second rotor 96. The end cover 93 is arranged on a side, axially opposite to the second spacer 88, of the second pump casing 94. The second pump casing 94 is fixed to the stationary bearing housing 50, and is axially separated from the first pump casing 84 by the second spacer 88, and includes a central cavity 94*a*, an inlet 94*b* and an outlet 94*c* which are in communication with the central cavity, and a confinement recess 94*d*. The other end 92*c* of the second oil suction pipe 92 leads to the inlet 94*b* of the second pump casing 94 via a channel 93*a* in the end cover 93. The second rotor 96 has substantially an annular shape, and is fixedly fitted on the end of the rotary shaft 30, and is accommodated in the central cavity 94*a* of the second pump casing 94. The second rotor 96 is provided with a lug 96*a* that is movably embedded within the confinement recess 94*d* in the second pump casing 94. A compression chamber is formed between the second rotor 96 and the second pump casing 94 by the second spacer 88 and the end cover 93. Thus, in a known manner in which a rotor pump operates, as the rotary shaft 30 rotates, the second rotor 96 swings inside the second pump casing 94 with the lug 96*a* as a fulcrum, to pressurize the oil entered from the inlet 94*b* of the pump casing 94, and discharge the oil from the outlet 94*c* of the pump casing 94. The oil discharged from the outlet 94*c* enters a central recess 93*c* of the end cover 93 through an orifice 93*b*, corresponding to the position of the outlet 94*c*, of the end cover 93, and the central recess 93*c* is in communication with the concentric hole 34*a* of the rotary shaft 30, thus, the oil can enter into the concentric hole 34*a* from the central recess 93*c*. In this way, the second pump 90 pumps oil from the oil compartment CO into the lubrication channel 34 of the rotary shaft 30.

The first pump 80 has a displacement (discharge capacity) greater than that of the second pump 90. In this embodiment, it is implemented by the axial width of the compression chamber of the first pump 80 greater than the axial width of the compression chamber of the second pump 90. As such, the amount of oil entering the oil compartment CO is greater than the amount of oil discharged from the oil compartment CO, thereby ensuring the amount of oil in the oil compartment CO. When the oil level of the oil accumulated in the oil compartment CO is higher than the predetermined height at which the overflow hole 62*c* is provided, the excess oil flows out from the overflow hole 62*c* into the motor compartment CM.

The inventors has conducted an experiment for comparing a horizontal compressor equipped with the partition plate/pumping mechanism according to this embodiment with a vertical compressor not provided with the pumping mechanism, and the results show that, with various refrigerants and under various working conditions, the power, cooling capacity, energy efficiency ratio and the like of the horizontal compressor are all better than those of the vertical compressor with the same volume, which indicates that the lubrication efficiency of the partition plate/pumping mechanism according to this embodiment is better than that of other currently available horizontal compressors.

In the art, a compressor in which a motor is in a suction pressure zone (i.e., a low pressure zone) is generally referred to as a low side compressor, and a compressor in which a motor is in a discharge pressure zone (i.e., a high pressure zone) is referred to as a high side compressor. Although, in this embodiment, the partition plate and the pumping mechanism are described by taking the low side compressor as an example, it can be understood that this embodiment can be applied to the high side compressor. In this case, although the formed motor compartment CM and oil compartment CO are both located in the high pressure zone, pressure balance can be achieved between the two through the overflow hole 62*c*, and the pumping mechanism PM can supply oil into the lubrication channel of the rotary shaft in the same way.

The horizontal compressor to which the partition plate or the pumping mechanism according to this embodiment is mounted can also be installed as a vertical compressor and can supply oil normally and operate normally.

Although in this embodiment, the partition plate and the pumping mechanism are described by taking the scroll compressor as an example, it can be understood that the embodiment can also be applied to horizontal compressors other than the scroll compressor as long as they generally supply oil from one end of the rotary shaft.

While the various embodiments of the present disclosure have been described in detail herein, it is to be appreciated that the present disclosure is not limited to the specific embodiments described and illustrated herein in detail, and other variations and modifications can be made by the person skilled in the art without departing from the spirit and scope of the present disclosure. All the variations and modifications fall within the scope of the present disclosure. Moreover, all of the components described herein may be replaced by other technically equivalent components.

The invention claimed is:

1. A pumping mechanism for a horizontal compressor, comprising:

a partition plate configured to separate an oil compartment from a motor compartment in a housing of the horizontal compressor, a motor being arranged in the motor compartment; and a pump assembly comprising a first pump and a second pump which are located in the oil compartment, wherein the first pump pumps oil from the motor compartment to the oil compartment, and the second pump supplies the oil from the oil compartment to a lubrication channel provided in a rotary shaft of the horizontal compressor, wherein the partition plate is made of a flat plate, and the partition plate has a partition plate main body extending in a vertical direction and a flange portion extending axially from a peripheral edge of the partition plate main body and fixed to the housing of the horizontal compressor, and wherein an annular sealing member is provided between the flange portion and the housing of the horizontal compressor, to separate hermetically the oil compartment from the motor compartment over the entire circumference of the flange portion.

2. The pumping mechanism according to claim 1, wherein the partition plate main body and the flange portion are integrally formed by stamping a metal plate.

3. The pumping mechanism according to claim 1, wherein the partition plate main body is provided with a central opening, and the central opening surrounds and is fixed to a bearing housing configured to support the rotary shaft.

4. The pumping mechanism according to claim 1, wherein the flange portion is welded to the housing at a plurality of through holes circumferentially arranged in the housing of the horizontal compressor.

5. The pumping mechanism according to claim 1, wherein a circumferential recess is provided in an outer circumferential surface of the flange portion or an inner circumferential surface of the housing and is configured to accommodate the annular sealing member.

6. The pumping mechanism according to claim 5, wherein a radial gap is provided in the outer circumferential surface of the flange portion or the inner circumferential surface of the housing and is open to the circumferential recess, and the radial gap has a radial dimension less than a radial dimension of the circumferential recess such as to allow the annular sealing member to unidirectionally enter the circumferential recess only by way of the radial gap.

7. The pumping mechanism according to claim 1, wherein a plurality of air gap inspection holes are provided in the partition plate main body, and the air gap inspection holes are plugged hermetically in the process of installation.

8. The pumping mechanism according to claim 1, wherein an overflow hole is provided in the partition plate main body at a predetermined height thereof, and is configured to communicate the oil compartment with the motor compartment.

9. The pumping mechanism according to claim 8, wherein the overflow hole is arranged in the partition plate main body at a position obliquely above a bearing housing for supporting the rotary shaft, such that projections of the overflow hole and the bearing housing on a horizontal plane are not overlapped.

10. The pumping mechanism according to claim 1, wherein the horizontal compressor is a low side scroll compressor.

11. The pumping mechanism according to claim 1, wherein the partition plate main body is further provided therein with an oil inlet hole, and the first pump has an oil suction pipe extending through the oil inlet hole into the motor compartment.

12. The pumping mechanism according to claim 1, wherein the first pump and the second pump are each a rotor pump driven by the rotary shaft, and the first pump has a displacement greater than a displacement of the second pump.

13. The pumping mechanism according to claim 1, wherein the pumping mechanism further comprises:

a first spacer located between a bearing housing supporting the rotary shaft and the first pump, wherein the first spacer is provided therein with an orifice to introduce oil pumped by the first pump into an inner cavity of the bearing housing, and the oil enters the oil compartment via a radial opening provided in the bearing housing;

a second spacer configured to separate the first pump from the second pump; and an end cover located on a side, opposite to the second spacer, of the second pump, wherein the end cover is provided therein with an orifice to introduce oil pumped by the second pump into a central recess of the end cover, and the central recess is in communication with the lubrication channel.

14. A horizontal compressor comprising a pumping mechanism which comprises:

a partition plate configured to separate an oil compartment from a motor compartment in a housing of the horizontal compressor, a motor being arranged in the motor compartment; and a pump assembly comprising a first pump and a second pump which are located in the oil compartment, wherein the first pump pumps oil from the motor compartment to the oil compartment, and the second pump supplies the oil from the oil compartment to a lubrication channel provided in a rotary shaft of the horizontal compressor, wherein the partition plate is made of a flat plate, and the partition plate has a partition plate main body extending in a vertical direction and a flange portion extending axially from a peripheral edge of the partition plate main body and fixed to the housing of the horizontal compressor, and wherein an annular sealing member is provided between the flange portion and the housing of the horizontal compressor, to separate hermetically the oil compartment from the motor compartment over the entire circumference of the flange portion.

* * * * *